United States Patent [19]

Willner

[11] 4,272,869

[45] Jun. 16, 1981

[54] UNITIZED ATTACHMENT DEVICE

[76] Inventor: Nancy J. Willner, 186 The Alameda, San Anselmo, Calif. 94960

[21] Appl. No.: 73,236

[22] Filed: Sep. 7, 1979

[51] Int. Cl.[3] ..... A44B 21/00; A45D 8/26

[52] U.S. Cl. ..... 24/3 R; 24/3 M; 24/108; 24/216; 132/48 R

[58] Field of Search ..... 24/3 R, 3 F, 3 K, 3 G, 24/3 M, 16 R, 16 PB, 216, 108; 132/48 R

[56] References Cited

U.S. PATENT DOCUMENTS

| | | | |
|---|---|---|---|
| 712,622 | 11/1902 | Traut | 24/216 |
| 2,080,379 | 5/1937 | Reiter | 24/216 |
| 2,106,728 | 2/1938 | Fenton | 24/216 |
| 2,163,016 | 6/1939 | Barker | 24/16 PB |
| 2,235,168 | 3/1941 | Reiter | 24/216 |
| 2,658,249 | 11/1953 | Wilson | 24/108 |
| 2,799,910 | 7/1957 | Weber | 24/216 |
| 2,818,871 | 1/1958 | Beaudry | 132/48 R |
| 2,933,793 | 4/1960 | Steinberg et al. | 24/216 |
| 3,141,321 | 7/1964 | Rinaldi | 24/3 K |
| 3,247,852 | 4/1966 | Schneider | 132/48 R |

FOREIGN PATENT DOCUMENTS

| | | | |
|---|---|---|---|
| 867116 | 5/1961 | United Kingdom | 24/16 PB |

*Primary Examiner*—Victor N. Sakran
*Attorney, Agent, or Firm*—Albert J. Hillman

[57] ABSTRACT

What is disclosed is the construction of a unitized attachment device utilizing a common snap fastener which allows ornamentation and/or jewelry to be readily placed in the hair, or may be used as a fastener for a wide variety of ornaments for personal or household decoration.

1 Claim, 4 Drawing Figures

UNITIZED ATTACHMENT DEVICE

This invention utilizes a common separable snap fastener of the general type commonly used as fastening means for garments, consisting of two basic parts, the stud and the socket. The purpose of this invention is to provide an attachment device which is used as a unit by providing a connecting hinge, on a snap fastener which attaches the two parts, the stud and the socket, permanently together in proper position, so as to provide an easy manual manipulation in opening the closed snap fastener by provision of an annular ring fixed to each part, the stud and the socket. Further, when a decoration or ornament is fixed to one part, preferably the stud, the unit can be snapped to the hair providing a fashion ornament that will not slip, or release spontaneously. This invention can also be used as a clasp as for a boutonniere, choker, bracelet, cuff links, etc.

Under ideal circumstances this invention would be fashioned by some state of the art moulding process, such as injection moulding and fashioned of a semi-rigid material, such that the connection between the two "halves", (stud and socket), of the snap fastener would function as a hinge. This hinge-like characteristic could be accomplished by a method already known in the state of the art.

In the example presented here, the snap fastener utilized is patented under the U.S. Pat. No. 2,080,379 and marketed as "Klikit" registered trademark #504,297, and is assembled using the common pronged ring and including both a strip of 16 mil. vinyl which functions as a hinge, and a semi-rigid annular ring of cast acetate in the relative position usually occupied by fabric when the snap fastener is used as a closure device on garments. The invention is not limited by the use of the "Klikit" snap as any of a variety of snap fasteners would function as well. The invention is not limited by utilization of flexible vinyl as the hinge attachment as other materials such as non-raveling machine made lace or cotton, nylon etc., have been demonstrated to be functional. Further, the utilization of the semi-rigid annular ring of a narrow range of relative dimensions must be included as an integral addendum to the snap fastener in order to allow for the easy manual opening of the unitized attachment device.

Figure 1:
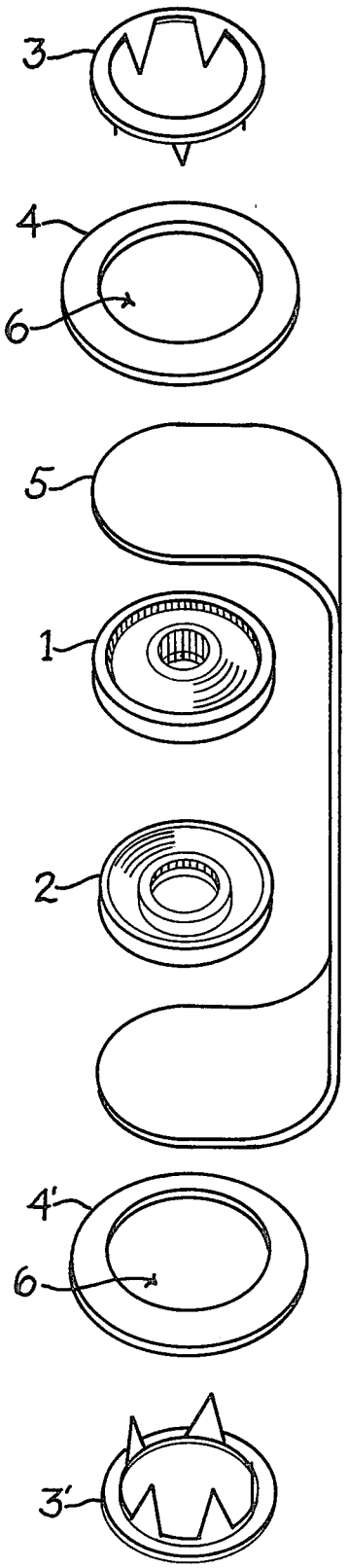
FIG. 1 is a three dimensional view of the assembly of this unitized attachment device, utilizing all the parts of the invention.

The device in the example drawing presented here is composed of seven elements as depicted in FIG. 1. The elements are: 1 a stud, 2 a socket, of such dimension as to accept the stud in a firmly held, but detachable assembly, 3 and 3' two pronged rings of such dimension as to snugly fit a peripheral recess on the outside of the stud and socket elements respectively where the prongs are flared to achieve a snug permanent fit, 4 and 4' are annular rings having an annular space 6 of a diameter such that the prongs of the pronged ring 3 pass through said annular space 6 with minimal tolerance, 5 a flexible strip of a material of such characteristics as to allow puncturing of itself without fracture by the prongs of the pronged ring 3 during assembly. The elements are assembled, usually utilizing dies and a press designed for this purpose.

Figure 2:
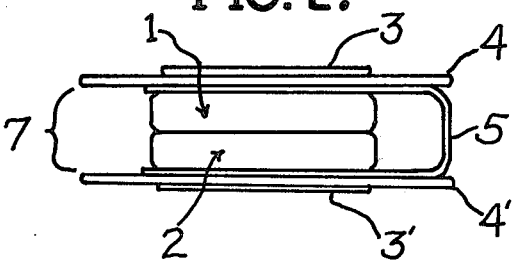
FIG. 2 is a side view of the invention showing all parts in a closed position.

The fully assembled device is shown in FIG. 2, in a closed position in a side view with all parts shown, and all features of these parts visible, as they would be visible in a closed position.

The size of the annular ring is limited by what will function as related to the flexibility of the material from which the annular ring 4 is made, and that diameter which would prevent easy manual opening between by restricting the angle which may be achieved between the annular rings 4 and 4' during the opening process. The function of the annular ring 4 in the example presented here is not intended to restrict the scope of this invention, as shapes other than circular may be used for this purpose. Extension of the flange on the side of the device which is hinged, will allow the device to be opened by squeezing the flanges together. However irrespective of shape, the dimensionary and material flexibility restrictions apply.

The snap fastener embodied in this invention, either moulded in a single unit, or assembled as in the example here FIG. 1, must have such a height, such that when the device is closed the tip of a finger may be wedged into the space FIG. 2, 7. between the annular rings 4 and 4' so as to allow leverage to be applied to open the closed attachment device.

Figure 3:
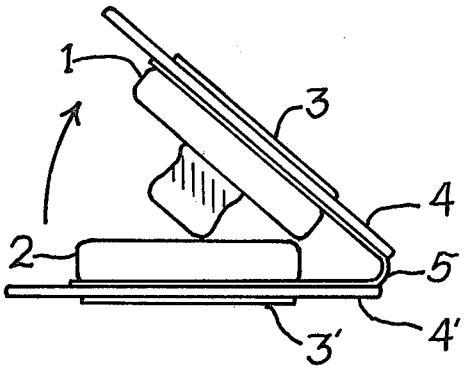
FIG. 3 is a side view of this invention in a partially open position.

FIG. 3 depicts the direction of motion (arrow) of the two segments of the unitized attachment device as force would be applied to the annular ring 4, assuming the annular ring 4' is held stationary, such action freeing the stud 1 from its socket 2. To fasten the attachment device, the force and subsequent motion would be reversed. FIG. 3 further demonstrates the function of the flexible hinge 5 which allows the full opening of the unitized attachment device, while maintaining the connection between its two segments, such that neither segment is separated from the other, such that the attached ornament is always available for use with its complete attachment device. Further the hinge 5 assists in the positioning of the stud and socket such that its placement as in the hair, is easily accomplished.

Figure 4:
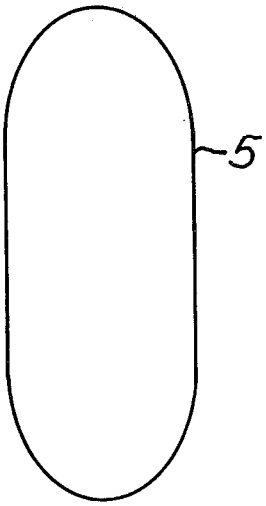
FIG. 4 is a top view of the smallest workable hinge in proportion to the snap fastener incorporated in this model.

FIG. 4 indicates the smallest size relationship of the hinge strap 5 to the balance of the parts depicted in FIG. 1 and the assembled device as depicted in FIGS. 2 and 3.

It should be pointed out that the unitized attachment device may be modified by lengthening the flexible hinge 5 and reversing the relative position of either the stud 1 or the socket 2 from the inside of the assembly to the outside of the assembly such that the device with appropriate ornamentation may function as the fastener for a bracelet or choker which allows easy application and removal of same.

An application of the novel unitized attachment device obvious to those well versed in the state of the art is as an attachment device for the placement or ornaments and jewelry in the hair. In this configuration an ornament would be attached, preferably to the outside of the stud segment. In operation the unitized attachment device would be positioned in the hair such that strands of hair would be captured between the stud and socket portions of the unitized attachment device when closed which would then remain in place until intentionally removed. Other possibilities and applications of my invention will be apparent to those skilled in the art. Since certain other obvious modifications may be made in the device without departing from the scope of the invention, it is intended all matter contained herein be interpreted in an illustrative rather than in a limiting sense.

What I claim is:

1. An attachment device comprising:

a snap fastener, including a stud, a socket, and a pair of pronged rings adapted for mating engagement with said stud and said socket;

a flexible hinge having first and second ends; and

A pair of annular rings sized to provide a manual grasping surface;

one said annular ring and said first end of said hinge captured between one said pronged ring and said stud, the other said annular ring and said second end of said hinge captured between the other said pronged ring and said socket, said annular rings having such dimensions to allow leverage to be applied to accommodate manual opening of said attachment device.

* * * * *